US006824405B2

(12) United States Patent
Hubbard et al.

(10) Patent No.: US 6,824,405 B2
(45) Date of Patent: Nov. 30, 2004

(54) MODULAR INTERFACE DEVICE WITH IMPROVED TORSION SHAFT

(75) Inventors: R. Eric Hubbard, Fisherville, VA (US); Luc Jean Langouet, Fisherville, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 0 days.

(21) Appl. No.: 10/286,867

(22) Filed: Nov. 4, 2002

(65) Prior Publication Data

US 2003/0087537 A1 May 8, 2003

Related U.S. Application Data

(60) Provisional application No. 60/330,887, filed on Nov. 2, 2001.

(51) Int. Cl.[7] ..... H01R 13/44

(52) U.S. Cl. ..... 439/136; 439/51; 439/266; 439/455; 439/465; 439/447; 324/761

(58) Field of Search ..... 439/51, 136, 266, 439/447, 455, 465; 324/761

(56) References Cited

U.S. PATENT DOCUMENTS 4,329,005 A * 5/1982 Braginetz et al. ..... 439/51
4,963,104 A * 10/1990 Dickie ..... 439/460
4,981,440 A * 1/1991 Werner et al. ..... 439/266
5,046,967 A * 9/1991 Majernik et al. ..... 439/610
5,588,853 A * 12/1996 Anthony ..... 439/136
5,609,492 A * 3/1997 Sato et al. ..... 439/136
5,788,534 A * 8/1998 Koegel et al. ..... 439/465
5,942,906 A * 8/1999 Stowers et al. ..... 324/761
5,966,023 A 10/1999 Burgers et al.

OTHER PUBLICATIONS

Virginia Panel Corporation Products, 5 pp., as described at p. 2 of the specification, no date.

* cited by examiner

*Primary Examiner*—Truc T. Nguyen
(74) *Attorney, Agent, or Firm*—DeWitt Roggin, PLLC; Timothy R. DeWitt

(57) ABSTRACT

A modular interface connection system having a receiver and a test adapter. The receiver includes a non-circular torsion shaft for providing improved strength and ease of assembly and a cover for providing safety. The test adapter has a frame, a shield, and one or more bushings, which provides easy access to contacts, patchcords and modules in the test adapter for troubleshooting, repairs and maintenance.

11 Claims, 14 Drawing Sheets

MODULAR INTERFACE DEVICE WITH IMPROVED TORSION SHAFT

CROSS-REFERENCE TO RELATED APPLICATIONS

Provisional application No. 60/330,887, filed Nov. 2, 2001; Related application Ser. No. 10/042,332 for a modular test adapter for rapid action engagement, filed Jan. 11, 2002.

STATEMENT REGARDING FEDERALLY SPONSORED RESEARCH OR DEVELOPMENT

Not applicable.

BACKGROUND OF THE INVENTION

1. Field of the Invention

The present invention relates broadly to electrical connectors and more particularly to that specialized class of connectors, which are increasingly required in computer interface equipment. Such equipment requires the frequent placement of individual test adapters with their multiple ranks and files of minute electrical contacts in operative engagement with the coacting electrical contacts of receivers. It is imperative that the receiver contacts and individual test adapter contacts engage with precision to minimize wear and to prevent damaging the delicate and expensive equipment.

2. Description of the Related Art

One example of prior art interface systems was disclosed in U.S. Pat. No. 4,329,005, entitled "Slide Cam Mechanism for Positioning Test Adapter in Operative Relationship with a Receiver," which was assigned to Virginia Panel Corporation. In the '005 Patent, the receiver included an inner frame and outer walls. Between the outer walls and adjacent side of the receiver frame were placed fixed hanger plates provided with straight slots and interior slides having coacting cam slots. The slides were driven by a hand lever and attached round torsion shaft with connected linkage having an over-dead-center locked position. The individual test adapter, or ITA, had four split roller dual bearings or rollers on common dry lube sleeves that would rotate oppositely during the camming action to minimize friction. The individual test adapter rollers rested on dwell shoulders of the cam slots and then descended through the straight slots during movement of the slides of the receiver to produce positive straight-on engagement of the test adapter and receiver multiple contacts. The slides had elongated linear guide bearings with dry lube pads for precision free movement. The slides were connected to a cylindrical torsion shaft via linkage.

Various covers and housing for interfaces are known. Several Virginia Panel products, PN's 410112341 and 410112458, use a box housing with detachable cover plates. Virginia Panel PN 410112394 and 410112454 have an L-shaped enclosure with a removable, hinged cover. The L-shaped cover also uses detachable cover plates to access connections underneath the covering. Flat cover ITA enclosures, such as Virginia Panel PN 410112286 and others, with a removable cover plate that mount to the ITA with screws are well known.

Another prior art system sold by Virginia Panel Corporation included a receiver that included slides similar to those disclosed in the '005 patent but used pins at two corners, diagonal from one other, on the receiver. These pins inhibited vertical movement of the ITA in the receiver to produce straight-on engagement. This prior art system, shown in FIG. 6, included machined siderails 501 and a cylindrical torsion shaft.

Although these devices generally functioned well and provided advantages over prior devices, the devices did not provide users with convenient access to the connectors and wires of a test adapter after the test adapter had been assembled. Such access may be desirable to perform troubling shooting tasks and repairs on the test adapters. Further, the devices included many components, including some machined parts, which contributed to expense and increased time for manufacturing and assembling the products.

SUMMARY OF THE INVENTION

The present invention has been made in view of the above circumstances and has as an object to provide an improved connection interface system having fewer parts and that is easier and less expensive to manufacture and assemble. A further object of the invention is to provide easier access to contacts and wiring for troubleshooting and repairs.

Additional objects and advantages of the invention will be set forth in part in the description which follows and in part will be obvious from the description, or may be learned by practice of the invention.

BRIEF DESCRIPTION OF THE DRAWINGS

The accompanying drawings, which are incorporated in and constitute a part of this specification illustrate some embodiments of the invention and, together with the description, serve to explain the objects, advantages, and principles of the invention. In the drawings.

DETAILED DESCRIPTION OF THE PREFERRED EMBODIMENTS

Figure 1:
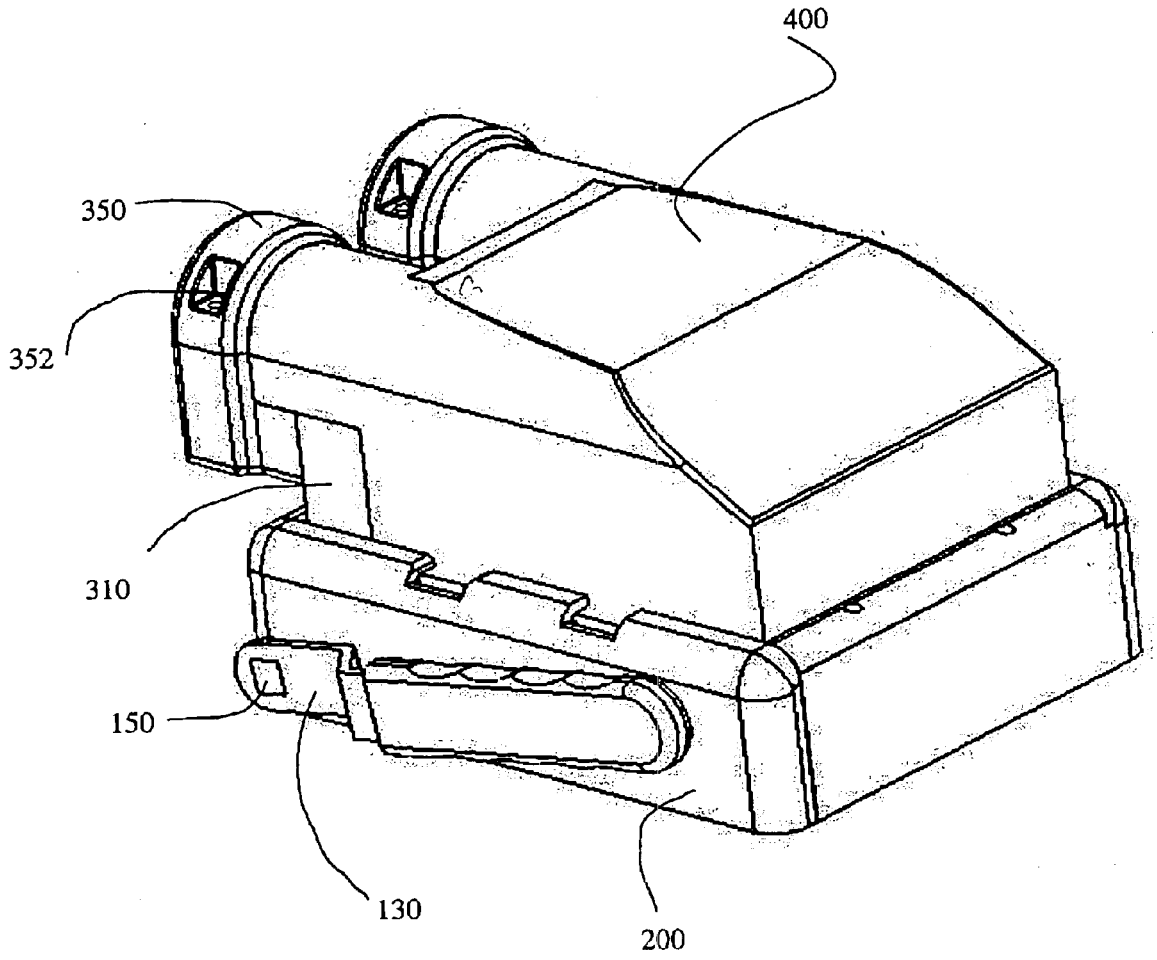
FIG. 1 is a front perspective view of a preferred embodiment of modular interface system in accordance with the present invention.
Figure 4:
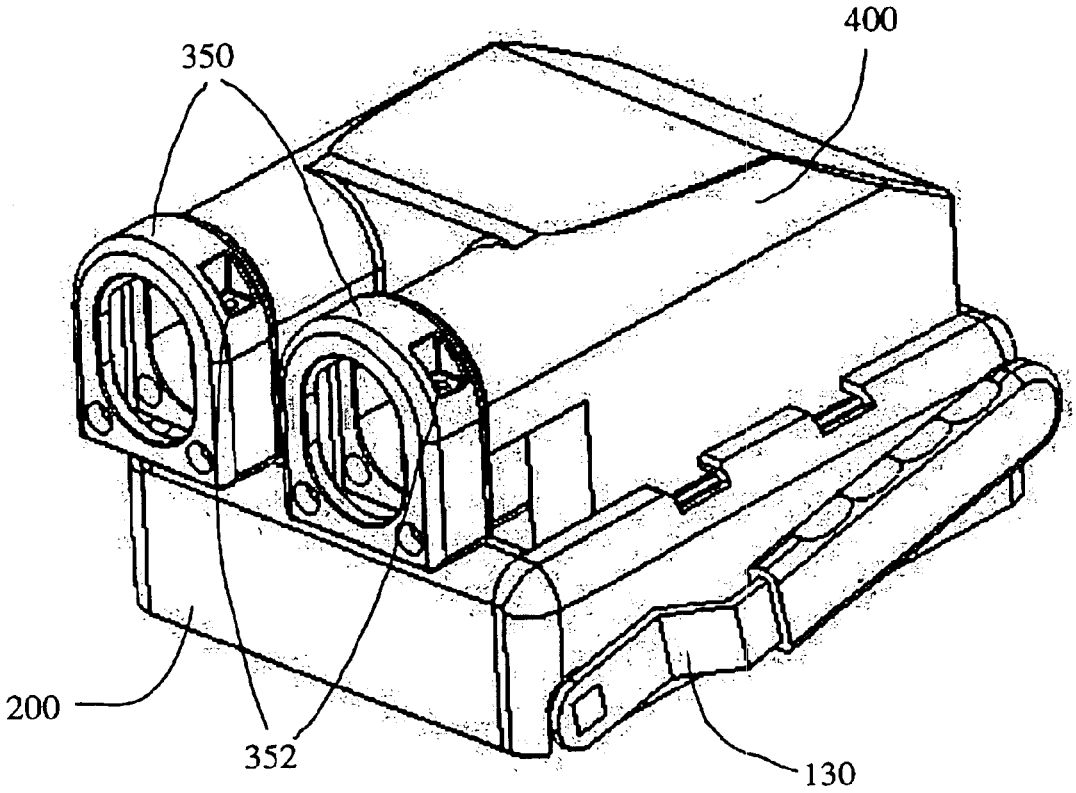
FIG. 4 is a rear perspective view of a preferred embodiment of a modular interface system in accordance with the present invention.

A preferred embodiment of the present invention is shown in FIGS. 1–5. The interface connection system or device includes two basic components, a receiver 100 and a test adapter 300. The receiver 100 typically is connected to automatic test equipment and the test adapter is typically connected to a unit under test. An interface connection system of the present invention with the test adapter 300 in a mated position with the receiver 100 is shown in FIGS. 1 and 4.

The receiver 100 includes a variety of sub-components, which are shown in FIGS. 2, 3, 5, 7 and 8. The aluminum receiver frame 110 includes a number of holes 114 in opposing ends for use in securing modules in the receiver frame 110. Standard modules such as those used with prior art interface systems and that are readily available on the market may be used with the receiver of the present invention. Guide pins 115 are placed as one or more corners of the receiver frame 110 for guiding a test adapter into the receiver 100. In a preferred embodiment, the receiver frame 110 has two guide pins 115 placed at comers diagonal from one another.

Slides 120 in this particular embodiment are made from flat metal plates. Each has two guide slots 124 and two Cam slots 122. The slides are mounted onto the receiver frame 110 using shoulder screws 112 and washers 118. A washer 118 and a bearing 117 are placed onto each shoulder screw 112. The shoulder screw 112 is then inserted through a guide slot 124 in a slide 120 such that the bearing 117 on the shoulder screw is within the slot 124 in the slide 120. The shoulder screw 112 is then screwed into a hole 116 in the receiver frame 110. Each shoulder screw 112 has a bearing 117 on it to permit its respective slide 120 to move linearly along the length of the receiver frame 110. Other embodiments for the slides 120 are of course possible and contemplated for use with the present invention, including a system having two or more slides 120 on each side of the receiver frame 110 in which each slide 120 includes a single cam slot 122 and is mounted on a single bearing 117 to provide non-linear reciprocation of the slide 120.

Each slide 120 in the preferred embodiment also includes a hole 121 in one end for receiving a bearing surface 167 of first link 166 which in turn is connected to the receiver frame 110 via a second link 162. The first link 166 has two bearing surfaces 167, 168. The second link 162 has a non-circular opening 163 for receiving a mating, non-circular torsion shaft 150, a bearing surface 164 for insertion into hole 115 in the receiver frame 110, and a hole 165 for receiving a bearing surface 168 of the first link 166. The non-circular torsion shaft 150 provides stable connections to the handle 130 and the second link 162 without the use of or need for pins while still transmitting torque. Linkage 162, 166 connects the non-circular torsion shaft 150, to the receiver frame 110. The linkage 162, 166 design with incorporated bearing surfaces 164, 167, 168, reduces the number of parts needed in receiver and interface test adapter design.

In the preferred embodiment, the non-circular torsion shaft 150 and non-circular opening 163 are square. However, other shapes having angles and planar surfaces, for example, triangles, octagons, a star shape, a criss-cross, and the like, allow the shaft to engage because of its shape, and avoids the need for pins or other additional parts and securing mechanisms. It will additionally be appreciated by one skilled in the art that it is not necessary for the entire torsion shaft 150 to have the non-circular shape. Rather, the ends of the torsion shaft that fits with the handle 130 and the links 162, 166, as further described below, is the minimum portion which must have a torque-transmitting, e.g., non-circular, shape. A spacer 169 also is placed upon the torsion shaft 150 on one side of the receiver frame 110 for spacing a handle 130 from the receiver frame 110.

Figure 5:
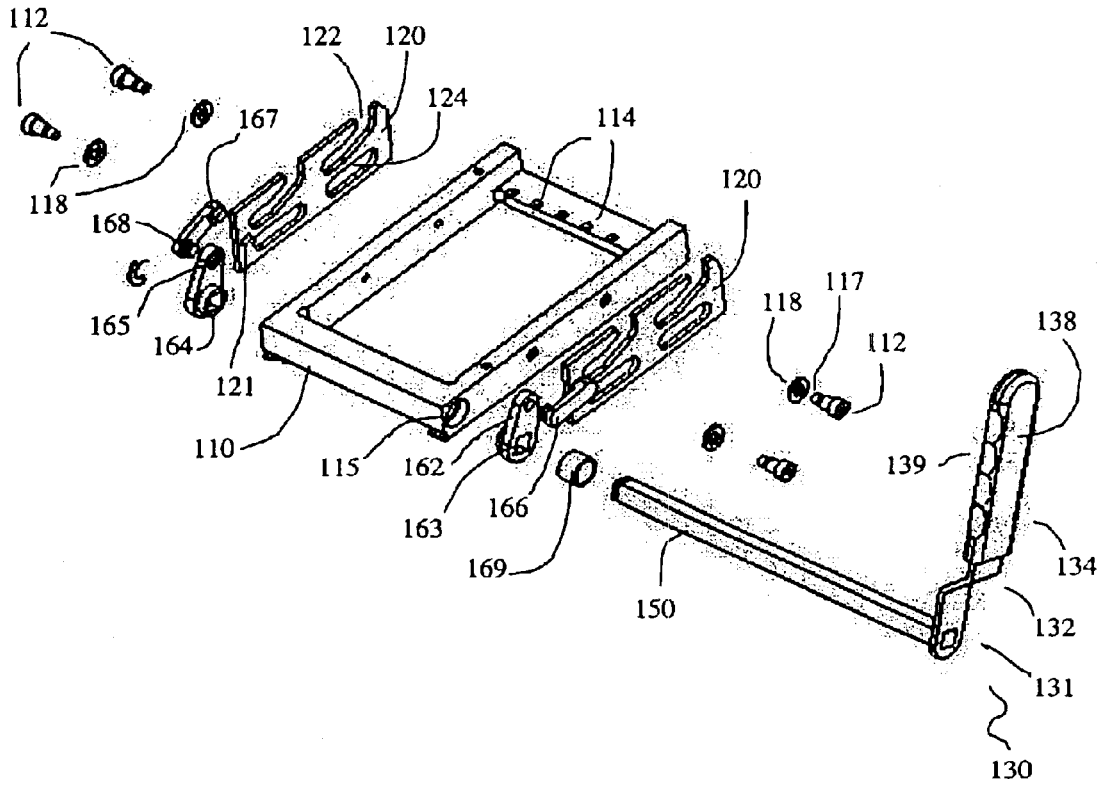
FIG. 5 is an assembly drawing of a preferred embodiment of a receiver (without a cover) of a modular interface system in accordance with the present invention.
Figure 6:
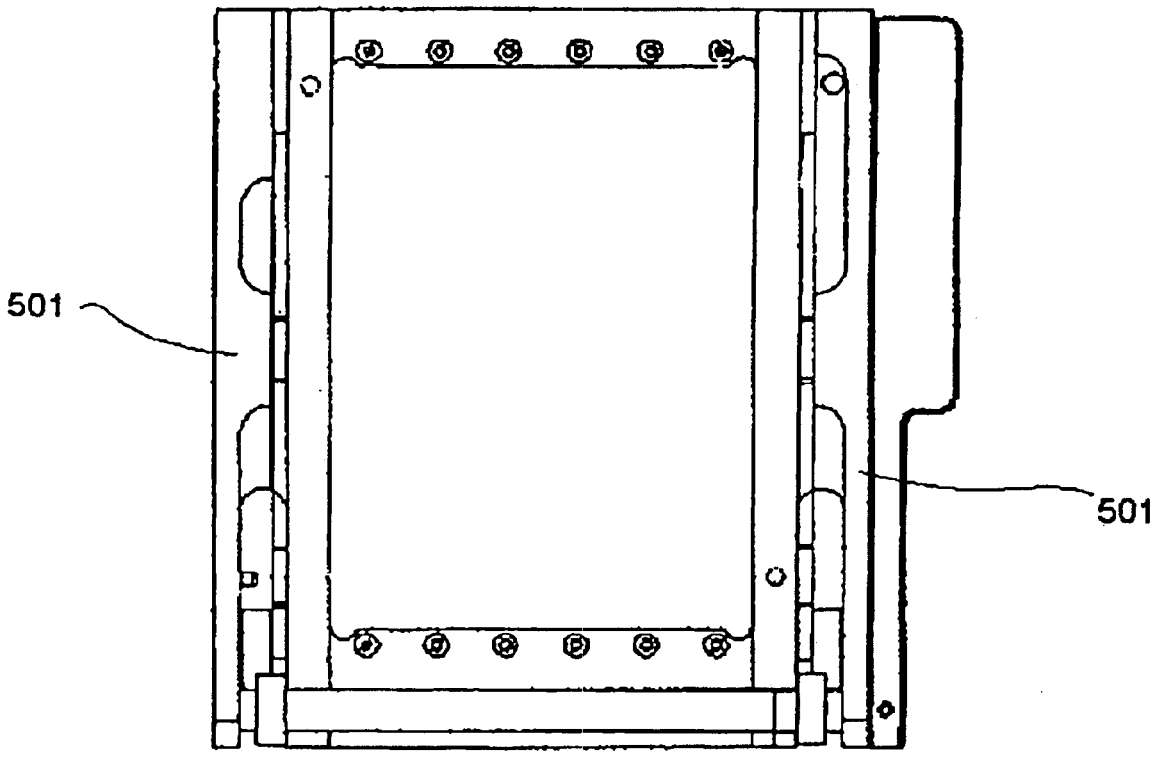
PRIOR ART Fig. 6
FIG. 6 is a front view of a receiver of a prior art interface connection device sold by Virginia Panel Corporation.
Figure 7:
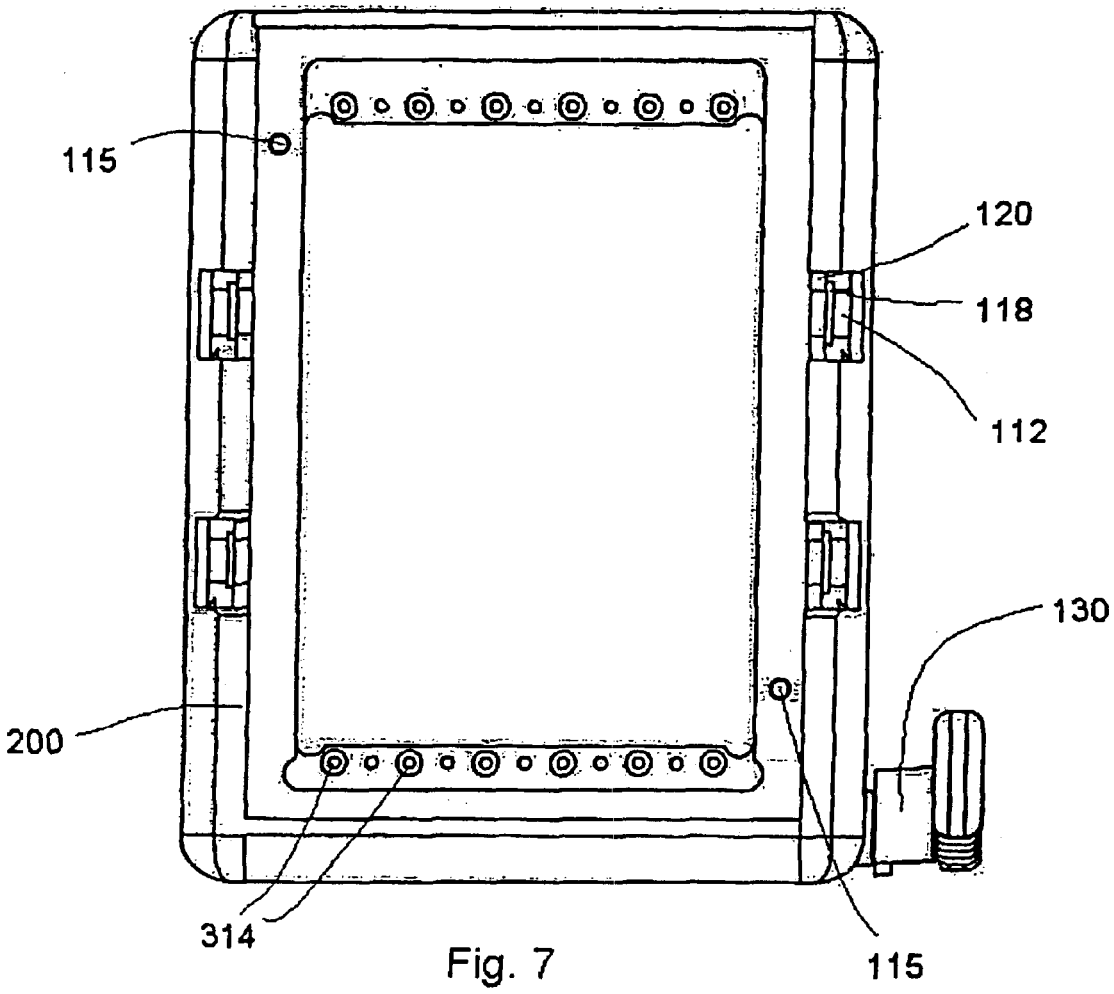
FIG. 7 is a top view of a preferred embodiment of an assembled receiver of the present invention.
Figure 8:
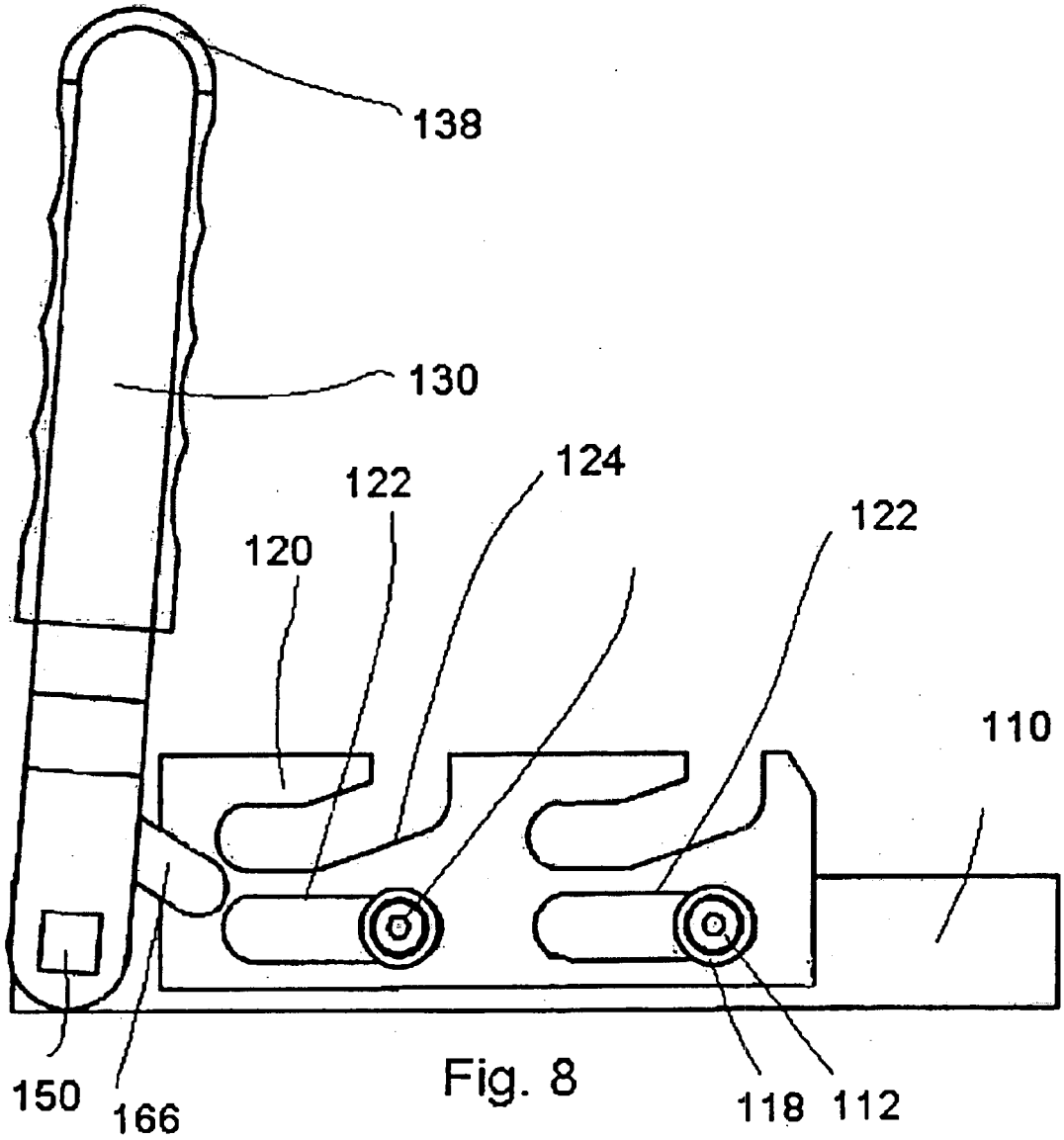
FIG. 8 is a side view of a preferred embodiment of a receiver of the present invention with its cover removed.
Figure 9:
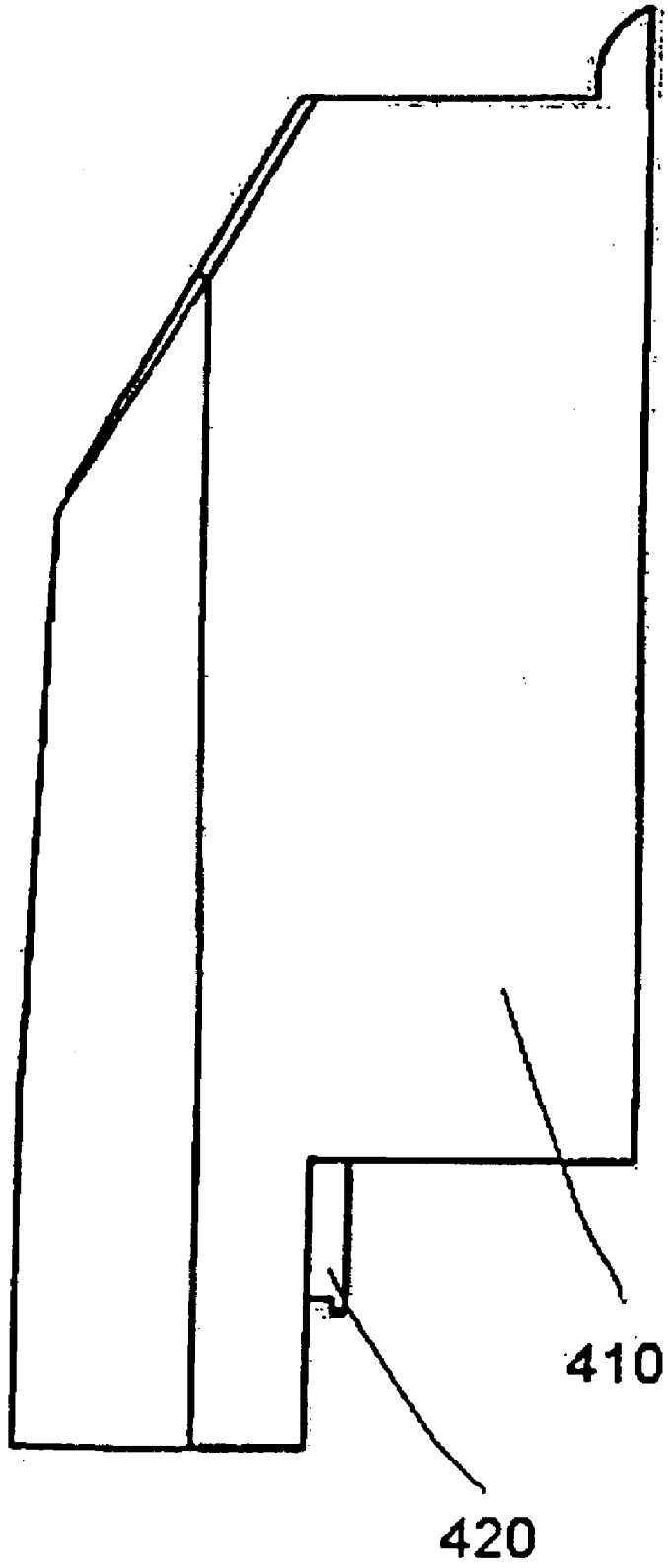
FIG. 9 is a side view of a preferred embodiment of a test adapter cover of the present invention.
Figure 10C:
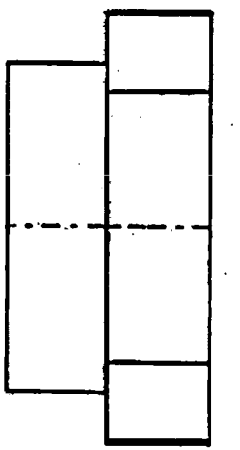
FIGS. 10*a, b*, and *c* are side, cross-sectional, and top views of a preferred embodiment of a portion of the linkage used on a receiver of the present invention.
Figure 10B:
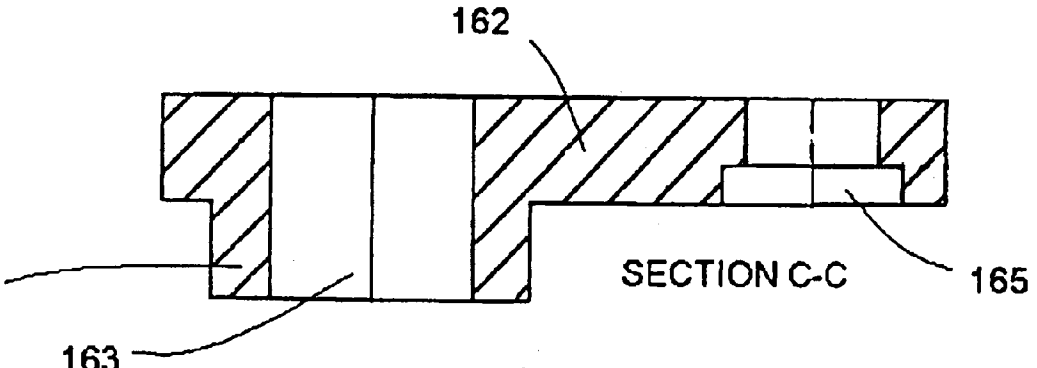
Figure 10A:
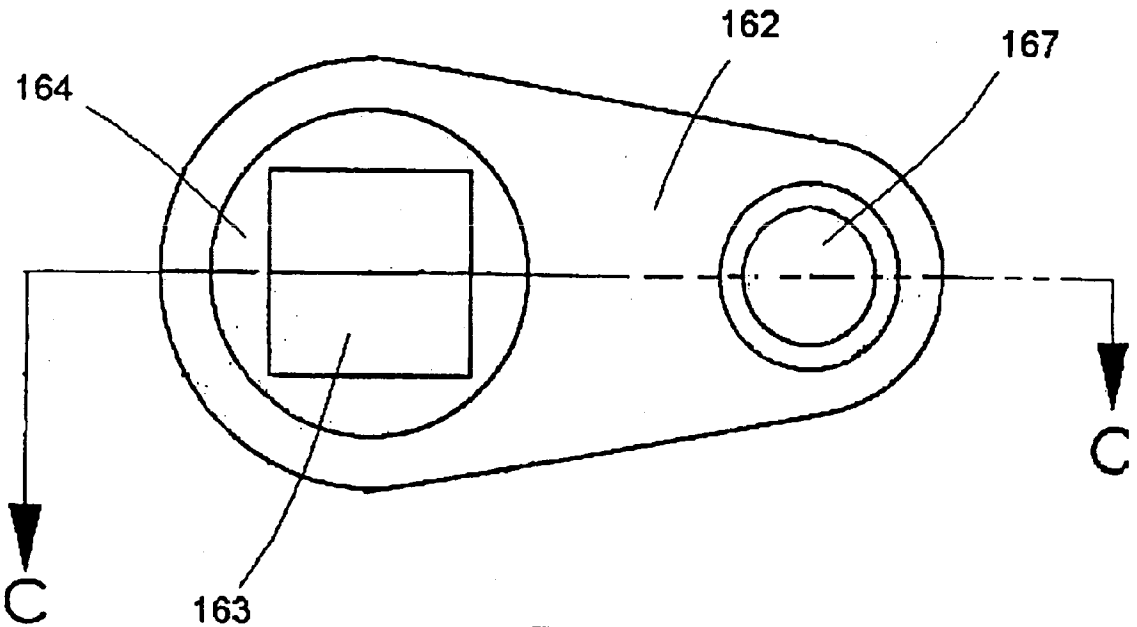

The handle 130 in the preferred embodiment has a recessed form in the preferred embodiment such that it comprises a first portion 131 having a non-circular hole near one end for receiving the non-circular torsion shaft 150, a second portion 132 extending at an angle away from the receiver frame 110, and a third portion 134 parallel to the first portion. Other embodiments may, of course, use handles of other forms, including a straight handle. A plastic or rubber grip 138 may be placed on the handle 130 such as is shown in FIG. 5. The grip 138 in the preferred embodiment has indentations 139 for accommodating a user's hand.

Once the torsion shaft 150 is inserted into the non-circular hole in the handle, the handle 130 is welded onto the torsion shaft 150. A cover 200 is placed over the receiver frame 110, slides 120, linkage 162 and 166, spacer 169 and torsion shaft 150. The cover 200 includes a slot 220 such that the torsion shaft 150 extends through the slot 220 and the handle 130 remains outside the cover 200. The cover 200 further has openings or slots 230 for permitting test adapter pins 320 to enter into the receiver 200. The cover provides safety and aesthetic functions by covering the linkage 162 and 166 and slides 120. The cover may be secured to the receiver frame 110 in a variety of different ways, including a lip structure for snapping the cover 200 onto the receiver frame 110 or screws.

The test adapter 300 includes a frame 310, one or more bushings 350, and a shield 400, or cover. The test adapter frame 310 is made from a metal such as aluminum and includes holes 312 for mounting standard modules 314 such as used in the prior art and are readily available in the market. Two pins 320 are mounted on each side of the test adapter frame 310. When the test adapter 300 is engaged in the receiver 100, the test adapter pins 320 enter into the openings of the cam slots 122 in the slides 120. When the handle 130 is closed, the slides 120 move and the test adapter pins 320 are forced into the face of the receiver 100. The test adapter frame 310 has holes (not shown) at one or more corners for receiving guide pins located on the receiver frame 110. In a preferred embodiment, the test adapter frame 310 has two holes placed at corners diagonal from one another.

Figure 2:
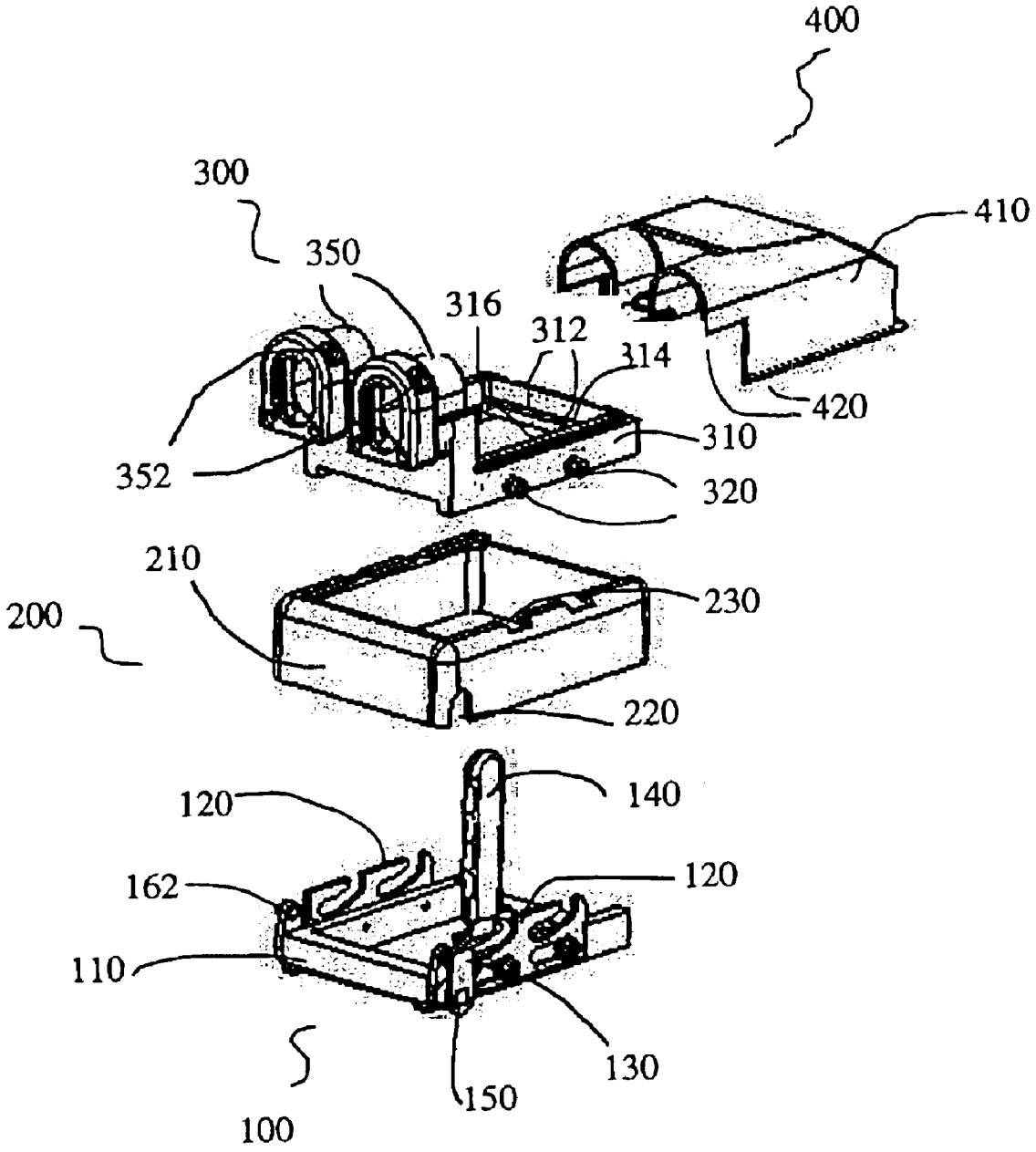
FIG. 2 is an isometric view of a preferred embodiment of a modular interface system in accordance with the present invention.
Figure 3:
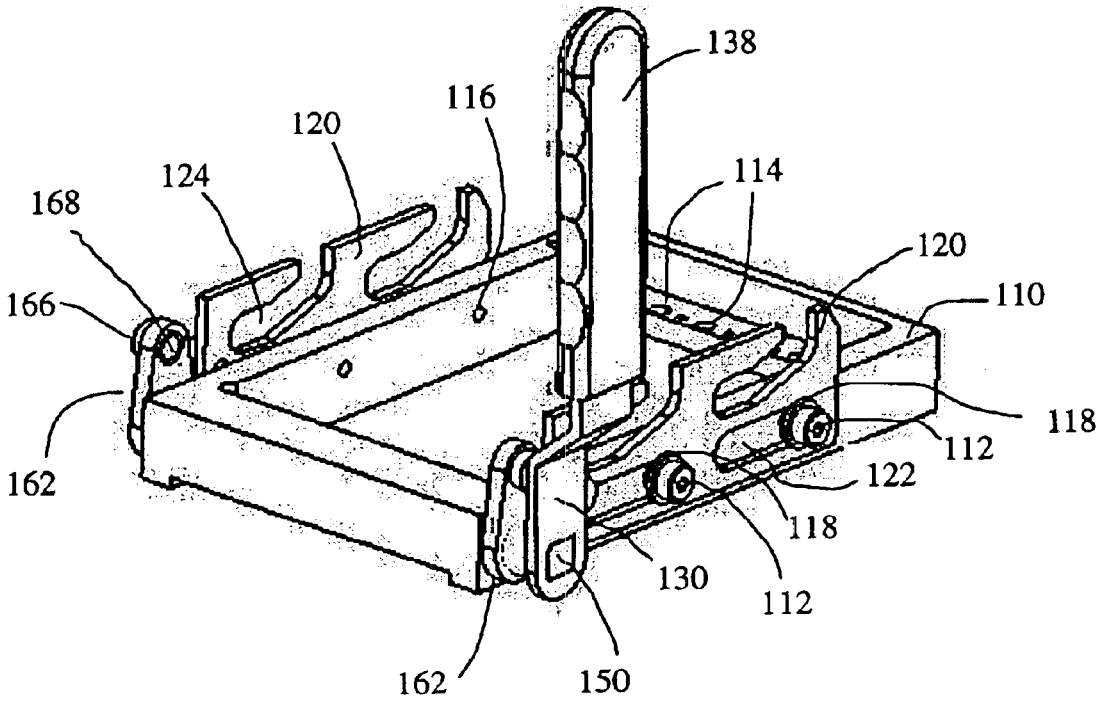
FIG. 3 is a perspective view of a preferred embodiment of a portion of a receiver of a modular interface system in accordance with the present invention.
Figure 11A:
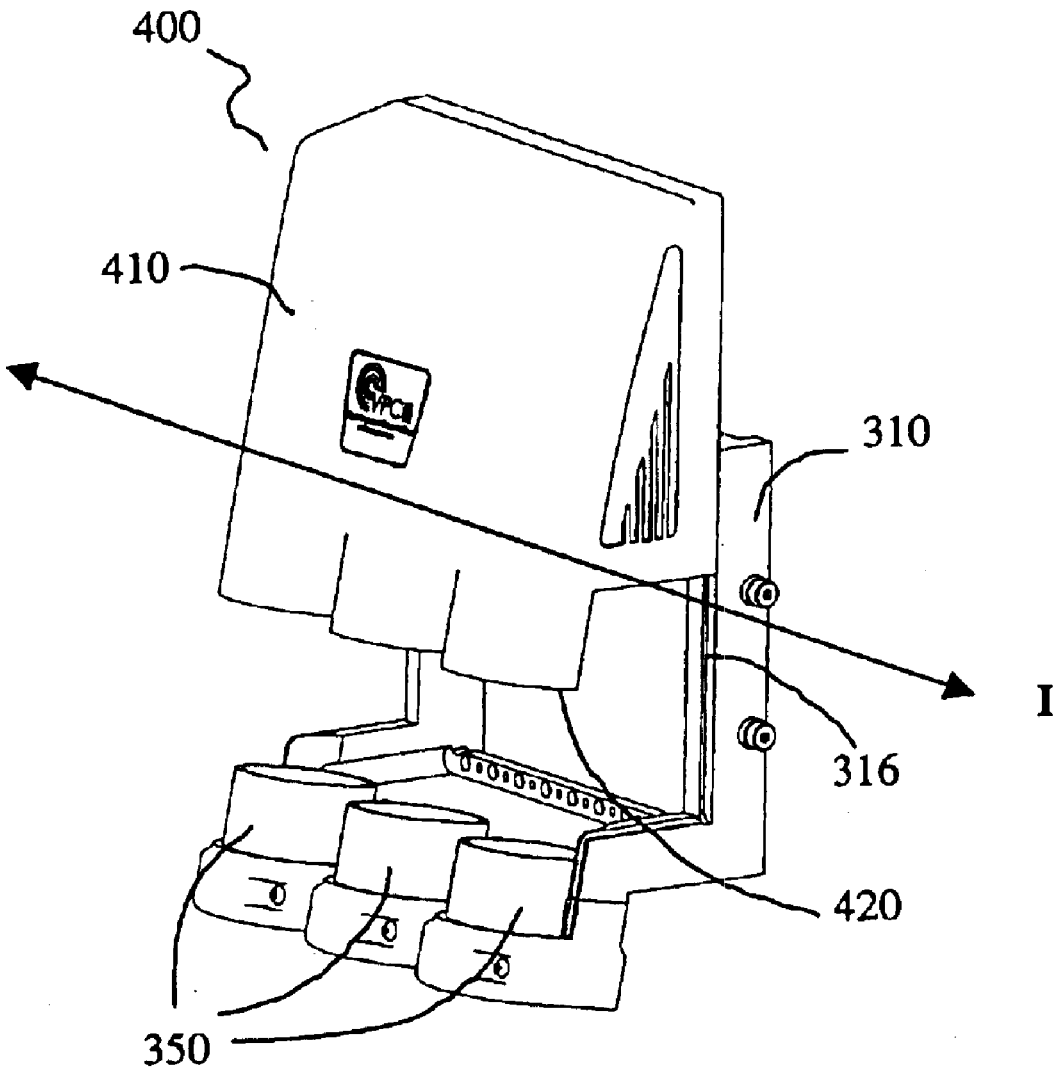
FIG. 11*a* illustrates a second side view of an embodiment of the present invention.
Figure 11B:
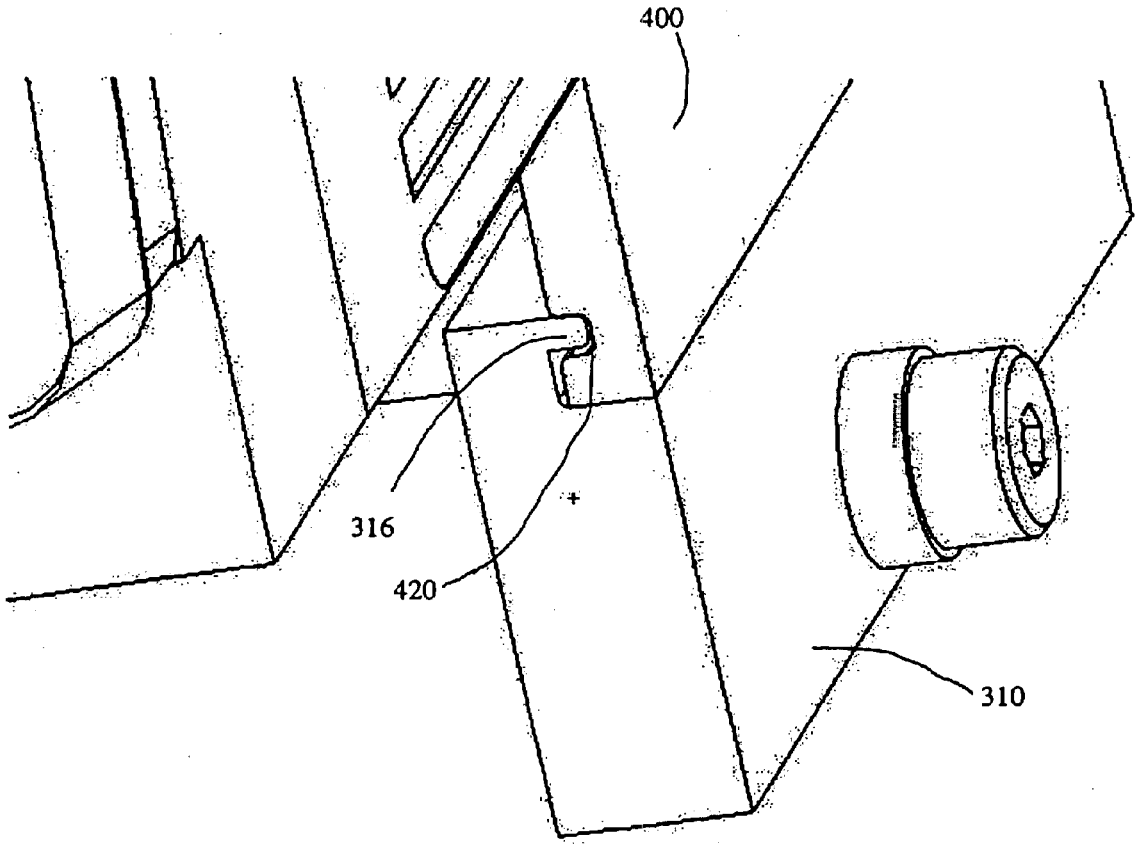
FIG. 11*b* illustrates a cross-sectional view of a preferred embodiment of the complimentary mating surfaces of the present invention.

The test adapter frame 310 and shield 400 include complimentary mating surfaces 316, 420, which allow the test adapter frame 310 to receive the shield 400 while they are removably engaged. As illustrated in FIGS. 2, 11*a*, and 11*b*, the test adapter frame 310 includes a tongue 316 structure for engaging with the shield 400. The shield 400 includes a cover body 410 and a groove structure 420. The tongue and groove structure 316, 420 slide together, permitting the shield 400 to be removed from the test adapter quickly and easily to perform troubleshooting, repairs, and maintenance to the contacts, wires, and modules mounted in the test adapter 300. FIG. 11*b* is the cross-sectional view of a mated tongue and groove structure 316, 420 taken at line I of FIG. 11*a*.

The shield 400 can be made from a wide variety of materials. Preferably, an insulator, e.g., thermal plastic, is used. However, other nylon, ceramic, or polymer, i.e., thermoplastic, materials may be used. Additionally, the shield 400 can be made from material that further provides EMI shielding for the electrical connections between the receiver 200 and the test adapter 300. Shielding may be provided by embedding conductive material within the shield 400 or by applying conductive material to the shield surface. Preferably, the shield 400 is formed from a 6/6 nylon with 13–30% glass and 10% stainless steel, having the property of being an insulator with some conductivity.

The complimentary mating surfaces 316, 420 of the shield and the test adapter frame preferably mate closely, so that when the shield 400 is installed on the test adapter frame 310, the juncture between is also an effective EMI shield for electrical connections housed within the receiver 200 and the test adapter 300, and EMI does not leak through the engaged tongue and groove structures 316, 420.

Figure 11C:
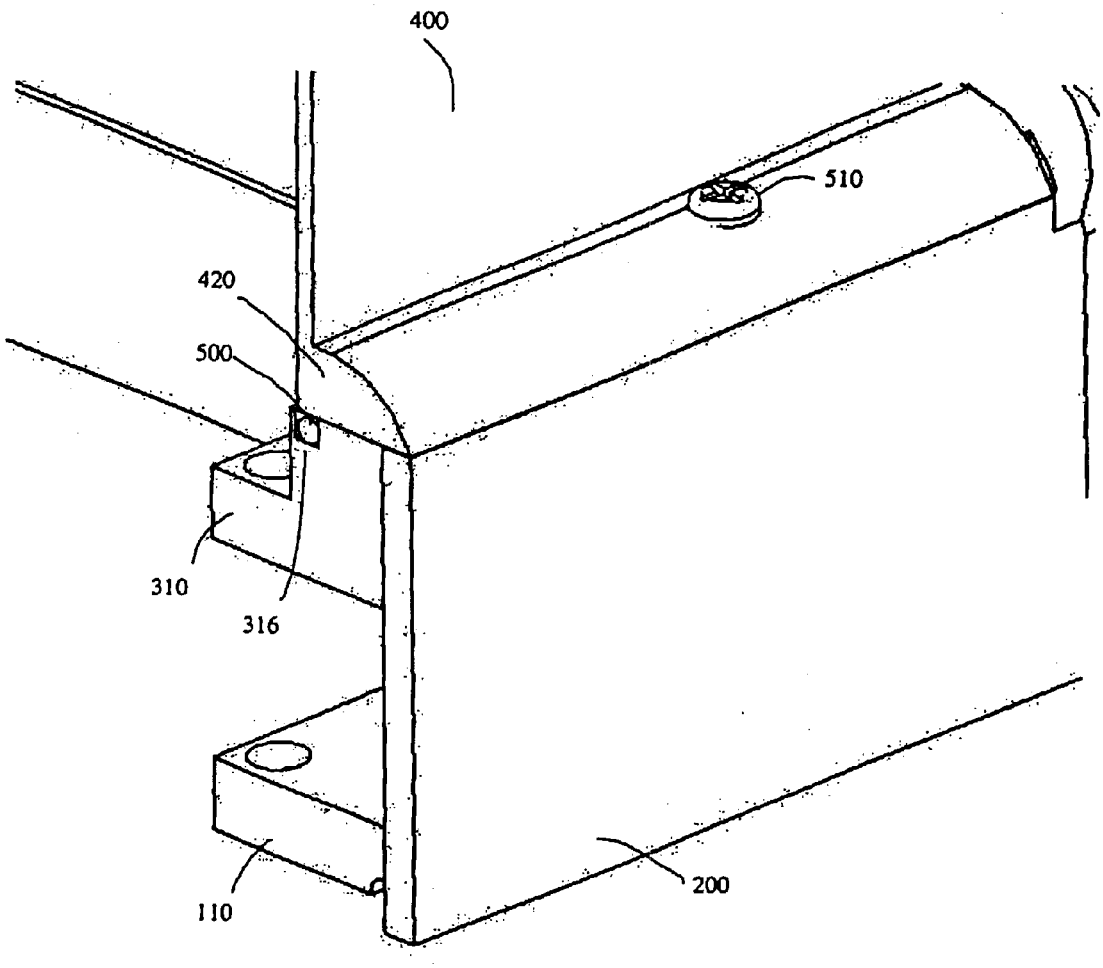
FIG. 11*c* illustrates a cross-sectional view of an alternative embodiment of the complimentary mating surfaces of the present invention.

Referring to FIG. 11*c*, an alternative embodiment of the complimentary mating surfaces 316, 420 for a shield 400 with EMI shielding properties is illustrated. The complimentary mating surfaces 316, 420 form a butt joint. An EMI gasket 500 is placed in a groove 316 and is positioned between the complimentary mating surfaces, 316, 420. At least one fastener 510, for example a screw, is inserted in pre-drilled, threaded holes (not shown) in the shield 400 and test adapter frame 310. Where EMI protection is not needed, the shield 400 can simply be screwed to the test adapter frame 310. Although the fastener illustrated in the preferred embodiment is a screw, it will be appreciated that other fasteners, such as latches, or quick turn fasteners may be used.

Another alternative embodiment of the complimentary mating surfaces 316, 420 for a shield 400 with EMI shielding properties, not shown, includes flat complimentary mating surfaces 316, 420. The EMI gasket 500 in the form of a flat tape is placed on either complimentary mating surface 316, 420. The shield 400 is secured to the test adapter frame 310 with at least one fastener 510, sandwiching the EMI gasket 500 between the test adapter frame 310 and the shield 400.

Although the embodiment of FIGS. 2, 11*a*, 11*b*, and 11*c*, illustrate the complimentary mating surfaces 316, 420, using a tongue and groove structure, it will be appreciated by those skilled in the art that a variety of structures can be used to secure the shield 400 to the test adapter frame 310 and provide EMI shielding, while still being easily removed when performing troubleshooting, repair, or maintenance. It will be further appreciated by one skilled in the art that the complimentary mating surfaces 316, 420 can be engaged in a variety of ways besides sliding without departing from the scope of the present invention.

Additionally, it will be appreciated that by those skilled in the art that, being complimentary, the complimentary mating surfaces can be reversed between the shield 400 and the test adapter frame 310 without departing from the scope of the present invention. For example, the groove may be located on the test adapter frame 310 and the tongue may be located on the shield 400. Similarly, the complimentary mating surfaces 316, 420 can be reversed between the shield 400 and the test adapter frame 310 in alternative embodiments of complimentary mating surfaces 316, 420.

At least one bushing 350 is mounted to the test adapter frame 310. Bushings 350 are mounted to the test adapter frame 310 using screws (not shown) placed through holes 352. The bushings 350 accommodate wires extending from contacts in modules placed in the test adapter frame 310. The bushings 350 may further include a clamp structure (not shown) for securing the wires extending out of the test adapter 300. The bushings 350 are mounted to the tested adapter frame 310 so that the bushing 350 remains in place to support and protect the accommodated wires extending from contacts in modules placed in the test adapter frame 310, regardless of whether the shield 400 is installed on the test adapter frame 310 or removed during any troubleshooting, repair, or maintenance activities. Alternatively, the bushings 350 can be formed integrally with the test adapter frame 310, or are otherwise fixed to the test adapter frame 310 so that the shield 400 can be removed without releasing the wires from the bushings 350.

Figure 12:
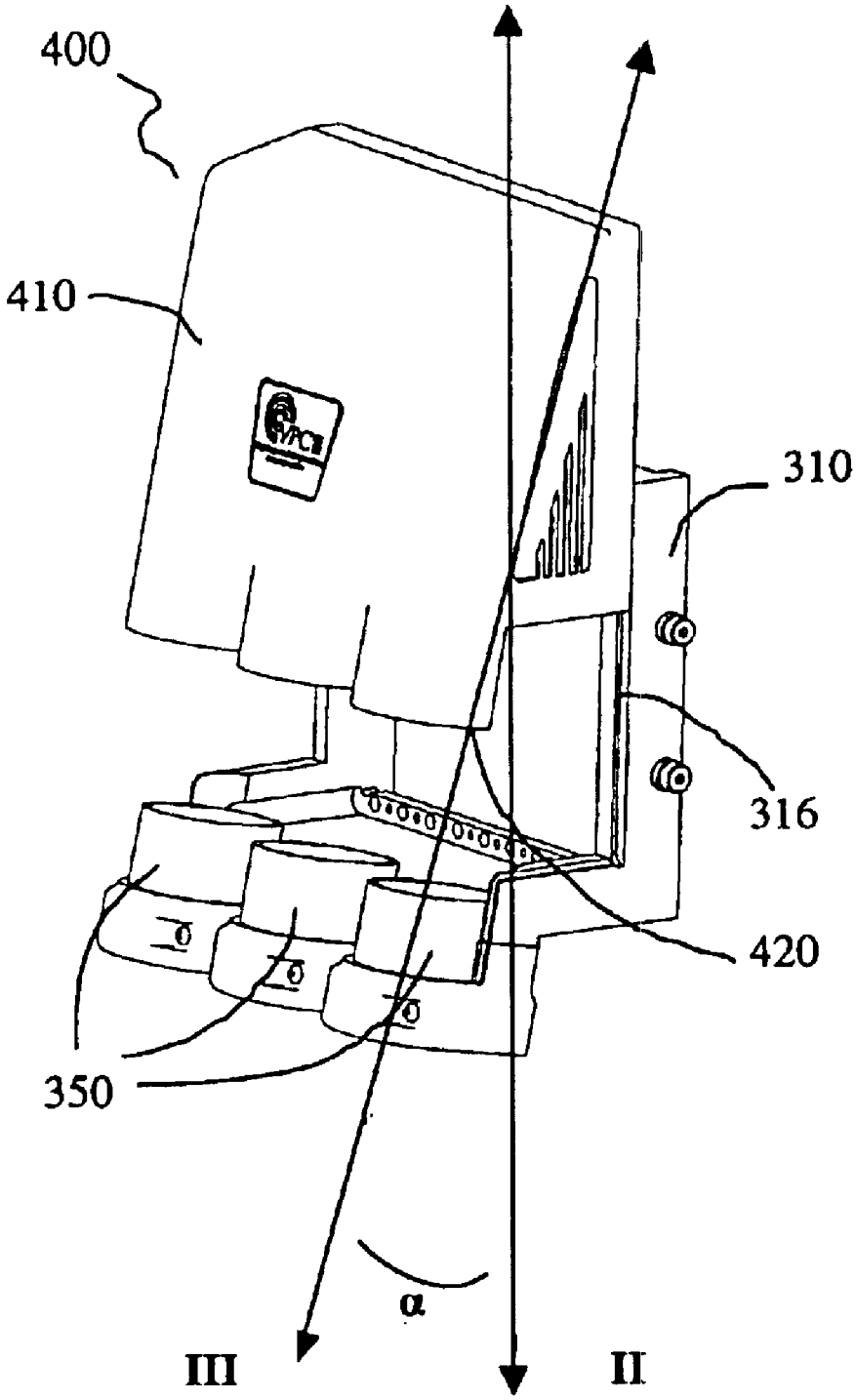
FIG. 12 illustrates a preferred bushing placement of the present invention.

Referring to FIG. 12, a preferred placement of the bushing 350 is illustrated. The test adapter frame 310 is positioned in a vertical plane shown by line II. The bushings 350 of this embodiment are angled as depicted by line III. An angle, $\alpha$, is formed measuring the distance the bushing 350 is angled away from the vertical plane. If the bushing is also vertical, any wire bundles extending from the bushing 350 block a worker's access to test equipment directly behind the wire bundle. If the bushing extends perpendicular to the vertical plane, wire bundles would also extend straight out from the vertical plane, making it difficult for workers to reach around the wire bundles or otherwise get close to the interface test adapter without accidentally de-mating any connections. Setting the bushing at an angle allows a worker access to test equipment directly behind the bushing 350 without disturbing the wiring in the bushing 350. The angle $\alpha$ is a value between 0 degrees and 90 degrees from the vertical plane of line III. Preferably, the angle $\alpha$ measures 5–25 degrees from the vertical plane of line III, and more preferably, 10 degrees, ±1 degree from the vertical plane of line III, to provide sufficient space from the vertical plane without extending away from the vertical plane so far that the wires are difficult to work around.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and the entirety of their equivalents.

We claim:

1. An interface test adapter comprising:

a test adapter frame comprising contact modules and a mating surface;

at least one bushing fixed to the test adapter frame for receiving a wire bundle; and a shield comprising a complimentary mating surface;

wherein the shield is mated with the test adapter frame adjacent to the bushing and easily removeable such that the contact modules are accessible while the wire bundle and bushing remain fixed.

2. The interface test adapter of claim 1 wherein the test adapter mating surface is a tongue and the shield complimentary mating surface is a groove.

3. The interface test adapter of claim 1 wherein the test adapter mating surface is a groove and the shield complimentary mating surface is a tongue.

4. The interface test adapter of claim 1 comprising a fastener for securing the test adapter frame and the shield.

5. The interface test adapter of claim 1 wherein the shield is made from an insulating material selected from the group consisting of nylon, ceramic, or polymer material.

6. The interface test adapter of claim 5 wherein conductive material is embedded within the insulating material.

7. The interface test adapter of claim 6 wherein conductive material embedded within insulating material comprises 6/6 nylon with 13 to 30 percent glass and 10 percent stainless steel.

8. The interface test adapter of claim 5 wherein the shield is coated with conductive material.

9. The interface test adapter of claim 1 wherein the at least one bushing is angled away from a vertical plane of the test adapter frame at an angle ranging from 0 degrees to 90 degrees away from a vertical plane of the test adapter frame.

10. The interface test adapter of claim 9 wherein the at least one bushing is angled away from a vertical plane of the test adapter frame at an angle ranging from 5 degrees to 25 degrees away from a vertical plane of the test adapter frame.

11. The interface test adapter of claim 10 wherein the at least one bushing is angled away from a vertical plane of the test adapter frame at an angle ranging from ten degrees plus or minus one degree away from a vertical plane of the test adapter frame.

* * * * *